US006494271B2

(12) United States Patent
Wilson

(10) Patent No.: US 6,494,271 B2
(45) Date of Patent: Dec. 17, 2002

(54) OFFSHORE FLOATING PRODUCTION METHOD

(75) Inventor: W. Brett Wilson, Sugar Land, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/116,232

(22) Filed: Apr. 4, 2002

(65) Prior Publication Data

US 2002/0157833 A1 Oct. 31, 2002

Related U.S. Application Data

(60) Provisional application No. 60/286,442, filed on Apr. 25, 2001.

(51) Int. Cl.[7] ..... E21B 15/02; B63B 35/14

(52) U.S. Cl. ..... 175/5; 175/7; 114/230.1

(58) Field of Search ..... 175/5, 7; 414/3, 414/4; 114/230.1, 293

(56) References Cited

U.S. PATENT DOCUMENTS

| | | | | |
|---|---|---|---|---|
| 4,493,282 | A | 1/1985 | Ortloff | 114/230 |
| 4,512,408 | A | 4/1985 | Danielson et al. | 166/349 |
| 4,601,252 | A | 7/1986 | Wuttudal | 114/230 |
| 4,602,586 | A | 7/1986 | Ortloff | 114/230 |
| 4,604,961 | A | 8/1986 | Ortloff et al. | 114/230 |
| 4,606,727 | A | 8/1986 | Koenig et al. | 441/5 |
| 4,819,730 | A | 4/1989 | Williford et al. | 166/355 |
| 4,841,895 | A | 6/1989 | Brewerton | 114/230 |
| 4,892,495 | A | 1/1990 | Svensen | 441/5 |
| 5,002,433 | A | 3/1991 | Paasche et al. | 405/210 |
| 5,025,742 | A | 6/1991 | Urdshals | 114/230 |
| 5,199,821 | A | 4/1993 | Huete et al. | 405/202 |
| 5,237,948 | A | 8/1993 | Hvide | 114/230 |
| 5,288,253 | A | 2/1994 | Urdshals et al. | 441/5 |
| 5,339,760 | A | 8/1994 | Korsgaard | 114/230 |
| 5,359,957 | A | 11/1994 | Askestad | 114/230 |
| 5,372,531 | A | 12/1994 | Boatman et al. | 441/4 |
| 5,381,750 | A | 1/1995 | Pollack | 114/230 |
| 5,486,070 | A | 1/1996 | Huete | 405/202 |
| 5,678,503 | A | * 10/1997 | Poranski, Sr. | 114/230 |
| 5,860,840 | A | 1/1999 | Boatman et al. | 441/5 |
| 6,085,851 | A | 7/2000 | Scott et al. | 175/7 |

* cited by examiner

*Primary Examiner*—William Neuder
(74) *Attorney, Agent, or Firm*—Stephen E. Koch

(57) ABSTRACT

A method of conducting operations to an offshore field from multiple separated drill centers using a floating vessel having a turret-mounted mooring element and a workstation separate from the mooring element in which the vessel is moored at a central mooring element location and operations are sequentially carried out at separate drill centers associated with the mooring element location by allowing the vessel to weathervane to a heading associated with a subsequent drill center once operations have been completed at a first drill center.

12 Claims, 4 Drawing Sheets

OFFSHORE FLOATING PRODUCTION METHOD

RELATED U.S. APPLICATION DATA

This application claims the benefit of U.S. Provisional Application No. 60/286,442 filed on Apr. 25, 2,001.

FIELD OF THE INVENTION

This invention relates to a method for the offshore production of hydrocarbons using a floating vessel.

BACKGROUND OF THE INVENTION

Numerous systems for producing hydrocarbons from offshore fields have been proposed and implemented since hydrocarbons were first produced from shallow water platforms early in the twentieth century. Initially,/these bottom-founded platforms facilitated production from fields generally brow the platform. More recently, industry has developed the ability to produce hydrocarbons from wells which extend outward from the region of, but do not necessarily terminate directly below, the platform. Broadly speaking however hydrocarbons produced from bottom-founded platforms derive from fields extending a limited physical area around the location of the platform, and a separate platform is usually required for production from fields which are not generally below a first platform's location. In addition, fields which are large in areal extent may require more than one platform. Once hydrocarbons have been produced, the platforms pump the hydrocarbons into available pipeline systems to enable the hydrocarbons to be transferred to appropriate markets.

As industry expanded its exploration activities into ever-deeper water depths, industry began to use compliant production systems. Compliant production systems are not rigidly fixed to the seafloor but rather are designed to respond to the are to carry the hydrocarbons to market. As with bottom-founded platforms, once a compliant production system is installed in the location for which it was intended, production of hydrocarbons derives from fields in the near region of the installation location.

One type of commonly used compliant production system is the floating production vessel ("FPV"). Initially, industry used FPV's for production, but relied on separate drilling vessels to pre-drill and workover the wells. To eliminate the cost of the separate vessel, FPV designs are now available which can drill, produce from, and workover wells; these vessels are often referred to as floating drilling production, storage and offloading vessels (FDFPSO's). Nevertheless, several limitations of these new-generation FPV's exist. These limitations include the complexity of incorporating the drilling system into the already complex turret system, from which the mooring system is deployed and around which the FPV weathervanes, or, in the alternative, restraining the FPV from weather-vaning and installing the drilling rig above a wellbay in the center of the vessel. The first limitation raises cost and operational complexity challenges. The second raises an operational challenge. Floating vessels should preferably retain the ability to respond to environmental forces, and for FPV's that means retaining the ability to weathervane in response to directional changes in those forces, or limiting the application to regions with mild environments. Finally, as with both bottom-founded platforms and other compliant production systems, FPV hydrocarbon production generally derives from field locations in the general region of the FPV. FPV's are held in place by spread mooring systems, and are confined to that location during the field's production life. As a result, FPV's generally suffer the same hydrocarbon production constraints that are inherent to bottom-founded platforms.

The problem faced by industry in the use of FPV's can be further described in association with FIG. 1. Vessel 15 includes a drilling rig 16 and a combined moonpool/turret 17. Drilling riser 19 and mooring lines 18 extend from moonpool/turret 17. For the purpose of this simplified depiction of the problem faced by industry, production risers, which during production would extend from moonpool/turret 17 to template 20, are not depicted. Wells 21*a*, 221*b*, 21*c*, and 21*d* extend from template 20, which rests on seafloor 6, to field 7.

Moonpool/turret 17 allows vessel 15 to weathervane, in other words point itself towards the direction of the prevailing wind, wave, and current forces, but mooring lines 18 do not allow substantial horizontal movement and vessel 15 is therefore restricted to a central mooring location approximately above template 20. This constraint results, among other reasons, from the need to minimize the bending stresses which would be created in riser 19 if vessel 15 horizontally moved substantially away from its central mooring location at a time when riser 19 was connected to template 20. As a result, vessel 15 suffers a location constraint similar to the constraint inherent to bottom-founded platforms. In other words, the FPV suffers the constraint that all risers, whether production or drilling, must extend back to a surface location which is at the central mooring location, and which in turn is approximately above the subsea template.

The production efficiency problem that results from this constraint is exemplified by wells 21*a*, 21*b*, 21*c*, and 21*d* in FIG. 1, which extend vertical distance 11 from seafloor 6 to field 7. Each well 21 also has a lateral reach 12, which is the lateral distance between a vertical line extending through template 20 (line not depicted) and the physical location of the bottom of that well. For example, well 21 a has lateral reach 12*a*, and well 21*b* has lateral reach 12*b*. It is understood to those skilled in the art that in deepwater the ratio of vertical distance 11 to the lateral reach 12 for a well is typically limited to a reach ratio of approximately one to three due to operational and physical constraints on the drilling equipment and the casing pipes used in the wellbores. This limitation places production efficiency constraints on the FPV system. Specifically, hydrocarbon fields extending from a central location a horizontal distance more than three times the average of the field's depth below the seafloor may not be fully producible from a single FPV system, and a separate production system may therefore be required to produce all recoverable reserves from the field. Furthermore, in deepwater, if the field of interest is more than one or two kilometers below the seafloor, the maximum lateral reach of the wells drilled to produce that field is generally even more limited. The reach ratios for such deepwater wells may be as low as one to one, or less. Thus, even though FPV's are not bottom-founded, they suffer the same inherent constraint of bottom-founded platforms-remote portions of the field may not be fully producible due to the horizontal location constraints on the FPV system.

One alternative of addressing this problem is to use separate subsea wellheads, and not the single well template 20 depicted in FIG. 1. Separate wellheads would allow wells 21 to extend to field 7 from different physical locations on seafloor 6, thereby extending the ability of the overall system to extract hydrocarbons from the entire field. The problem faced by this alternative arises during the drilling and workover phases of operations. By placing separate wellheads on seafloor 6, riser 19 must connect from vessel 15, in its central mooring location, to the different physical locations of the wellheads on seafloor 6, thus again creating bending stresses in riser 19. In the alternative, the mooring system could be adjusted each time riser 19 must connect to a different wellhead location so that those stresses are minimized. Any such mooring system would require special design considerations, however, since standard mooring systems are not designed for frequent changes. In addition, it is operationally undesirable to be required to make repeated adjustments to a mooring system, due to the cost of the support vessels that are often required to make such adjustments. Finally, this alternative is undesirable because the production riser system, not depicted in FIG. 1, would then be required to have the ability to move laterally to all locations to which the FPV might need to be re-moored, and although production riser systems are often compliant in nature, such a requirement adds system design constraints which are preferably avoided.

It is apparent that a need exists for a method of conducting floating operations in which the FPV can weathervane in response to environmental forces and can perform drilling, workover and other operations over a variety of subsea wellhead locations, with each such operation carried out simultaneously with production to the FPV, and in which obtaining access to the various subsea wellhead locations does not require substantial changes to the permanent mooring system. At the same time, a method is desired which has the capability of extending the reach of production wells to remote portions of the field that is to be produced. The present invention satisfies these requirements.

SUMMARY

This invention relates generally to a method of conducting operations from a floating vessel to an offshore field. Specifically, the method involves a floating vessel having a turret-mounted mooring element and a workstation separated from the mooring element in which the vessel is moored at a central mooring location and sequentially located above one or more drill centers associated with the central mooring location. Upon completion of operations at a first drill center the vessel is weather-vaned to the heading associated with a second drill center for operations at the second center. Production can be ongoing from the first drill center while operations are ongoing at the second center. Separation of the turret-mounted mooring element from the workstation expands the reach of the wells into the field to be produced.

BRIEF DESCRIPTION OF THE DRAWINGS

The features of the present invention will become more apparent from the following description in which reference is made to the drawings appended hereto. Reference numbers which are used in more than one of the drawings refer to the same function in each drawing.

Figure 1:
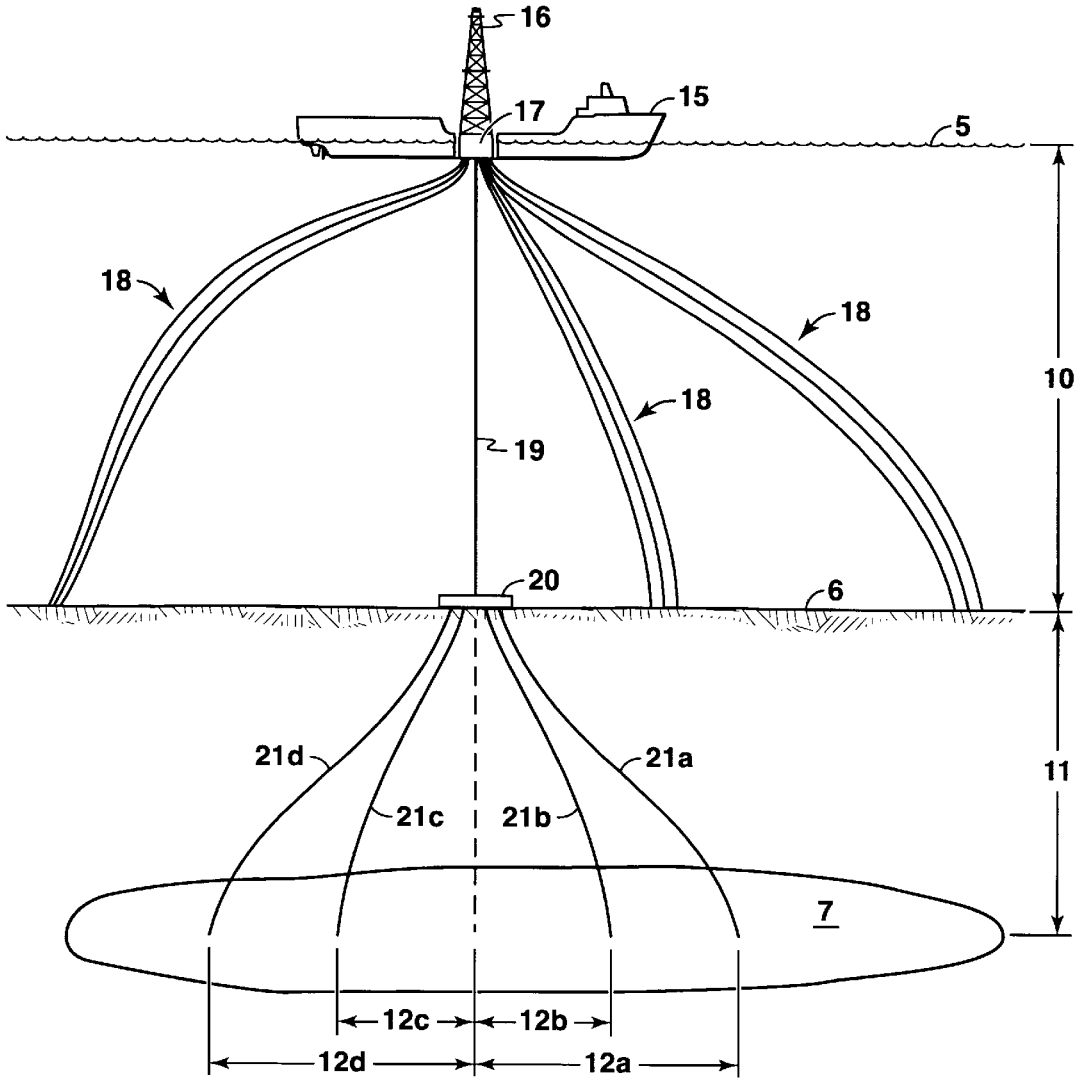
FIG. 1 (PRIOR ART)
FIG. 1 depicts the problem addressed by prior art floating production vessel systems.

Changes and modifications in the specifically described embodiments can be carried out without departing from the scope of the invention, which is intended to be limited only by the scope of the appended claims.

DETAILED DESCRIPTION OF THE INVENTION

The present invention is a method which enables drilling, workover, production, storage and offloading operations to be performed from a single FPV without requiring the drilling and/or workover rigs to be incorporated into the turret. This eliminates the need for a specially designed FPV turret system that would impose limitations on the number of production risers and restrict the design of the turret-to-hull fluid transfer system to a drag chain system. The present invention enables subsea well placement in one or more arcs on the seafloor, rather than in a single location as is the case with through-turret drilling FPV's. This characteristic expands the FPV's maximum well reach distance by 250 meters or more, which is advantageous for geographically extensive and/or shallow submud reservoirs.

Referred to as the Revolving Drilling Floating Production, Storage and Offloading System (RDFPSO), the method relies for cost and operational simplicity on well-known components in the offshore industry. The RDFPSO uses a turret-moored FPV, with drilling and/or workover rigs installed on the hull at a location separated from the turret. This separation of drilling/workover from the turret facilitates use of a conventional turret system to moor the FPV and convey production and other fluids between the subsea system and the processing equipment, since drilling components are not required to extend through the turret. Subsea wells will typically be positioned in arcs on the seafloor, with the RDFPSO's mooring location, centered on the location of the turret, denoting the approximate center of the arcs.

The RDFPSO may utilize either a converted or a new-built vessel. The turret may be either passively located at either the bow or the stern of the vessel's hull, with the vessel naturally weather-vaning in response to the environment, or actively located anywhere between the bow and the stern, with thruster assistance required to rotate the hull. Passive turrets may include either external turret systems, such as catenary anchor leg systems, single-anchor-leg systems, and jacket-yoke systems, or internal turrets. In addition, the RDFPSO is not constrained to any specific fluid transfer system, which may be either a swivel or a drag chain, since as there is no drilling rig installed above the turret.

The RDFPSO may incorporate one or more workstations for any mix of drilling, completion, or workover activities, or any of these functions individually. For example, the RDFPSO may be configured with drilling and/or workover rigs installed above moonpools in the hull or cantilevered from the sides of the vessel. Simultaneous drilling and workover operations may be performed on two wells for embodiments of the RDFPSO which have two workstations.

The RDFPSO is not limited to any specific subsea well configuration, and subsea wells may be installed in any of a number of geometric patterns on the seafloor. This facilitates tailoring of the characteristics of the well program to the field to be developed. Specifically, the RDFPSO is not limited to use of a template, or to wellheads in a relatively confined area below the vessel. In all such cases, the RDFPSO enables direct access to the subsea wells.

An auxiliary drilling station-keeping system may be installed on the RDFPSO to maintain station during drilling and workover operations and to assist vessel heading changes which may be required between drilling, workover, and offloading operations. This station-keeping system may consist of a simple ancillary mooring system, with any desired combination of on-board windlasses, chain-jacks and support vessels used to change heading when needed, or, alternatively, a thruster system may be installed.

The RDFPSO concept may be employed for permanent production, mobile production, phased development, early production, or extended well testing, among other applications. However, the RDFPSO is preferably used as a permanent production facility for remote, deepwater developments where oil export via tankers is required. This preference results from the ability to perform all necessary production functions onboard the RDFPSO vessel, thereby avoiding costly use of separate deepwater drilling and workover vessels. In addition, the RDFPSO is preferably used where production volumes and the tanker export market require a relatively large storage volume to be incorporated into the production system.

The RDFPSO's turret enables tandem offloading to be used, with offloading hawsers at bow or stem and offloading hoses coming from amidships. As all offloading would occur directly from the RDFPSO, no separate offloading buoy would be needed, thus resulting in cost and execution advantages for remote, deepwater development projects.

Although pre-drilling of some production wells with a mobile offshore drilling vessel unit may be desirable, such a separate drilling vessel would not be necessary for the RDFPSO system, another cost and execution advantage of the RDFPSO system.

The RDFPSO is not limited to specific design environments, but may preferably be employed in mild-to-moderate environments, such as offshore West Africa or Brazil. The applicability of the RDFPSO to any specific location depends on the design environment and the size and response characteristics of the vessel, among other factors which will be understood to those skilled in the art.

Figure 2:
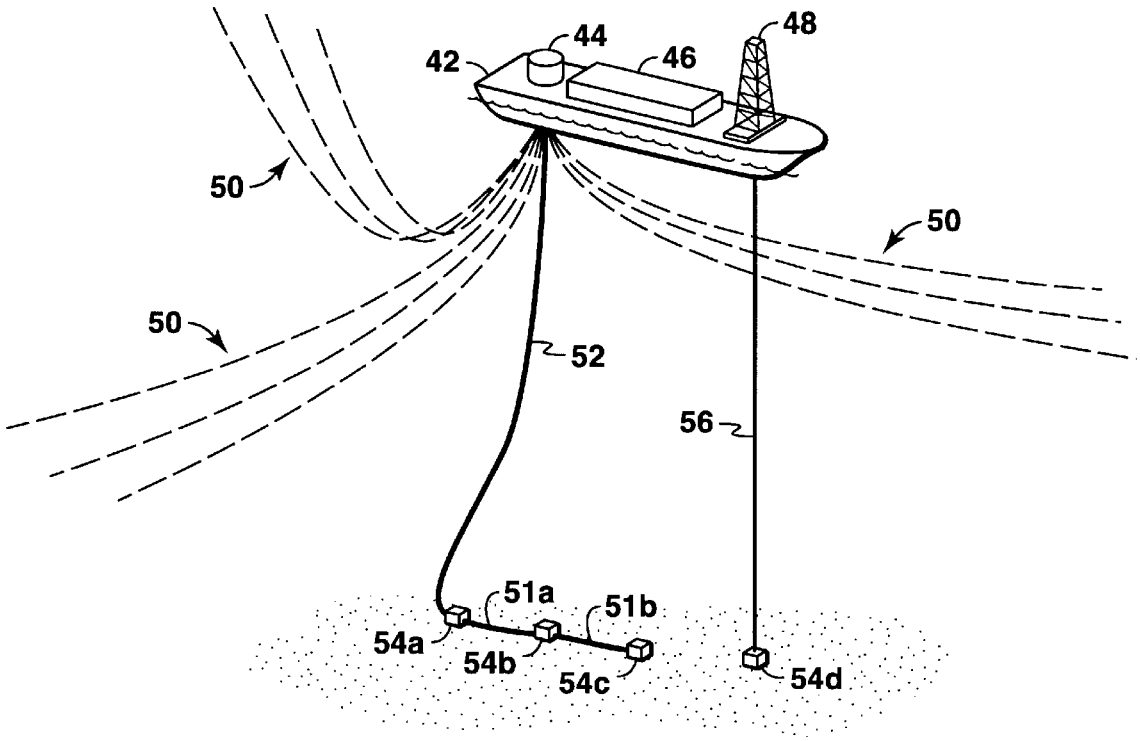
FIG. 2 depicts a first embodiment of the RDFPSO of the present method.

The method of the present invention may be described in detail by reference to FIG. 2, which depicts a production and drilling embodiment of an RDFPSO system. In FIG. 2, vessel 42 comprises turret system 44, topside facilities 46, and workstation 48. As noted above, turret system 44 may be any number of turret system designs that are well-known in industry, for example such as a conventional, internal, passive turret.

Topside facilities 46 will be designed to accommodate the activities for which the RDFPSO is designed, such as produced liquids processing and or drilling liquids handling. Workstation 48 will be designed to carry out the operations for which the RDFPSO is designed, and in particular may include equipment for drilling, completing, or working-over wells. Workstation 48 may be installed in a dedicated moonpool, or in an over-the-side-of-the-hull configuration. Vessel 42 may also include liquids storage and offloading capabilities (not depicted in FIG. 2).

Vessel 42 will be moored from turret system 44 using mooring lines 50. Any mooring system configuration may be used for mooring lines 50, such as a conventional 9-line chain-wire-chain mooring system. Turret system 44 allows vessel 42 to weathervane in response to changes in environmental forces. In the embodiment of FIG. 2, turret system 44 also allows production wells 54 to produce liquids through riser 52 to vessel 42, thereby allowing processing, storage, and offloading of produced hydrocarbons. Riser 52 may be a continuous flexible flowline, or may be a self-standing, hybrid production riser or other riser system which conveys full well-stream fluids from the subsea wells to a near-surface position where flexible pipe jumpers connect the riser to the turret. In addition, water or gas injection may occur from flexible pipe risers running to injection wells on the seafloor (not depicted).

The method of the RDFPSO system facilitates simultaneous production and drilling activities from vessel 42, as follows. Vessel 42 is moored in a desired central mooring location, most commonly by anchor-handling vessels which place mooring lines 50 and anchors (not depicted) in their desired locations. The process of mooring floating vessels is well known in the art. Vessel 42 then commences drilling production wells 54 using drilling riser 56. When a first production well 54*a* has been drilled to the desired depth, it may be connected to production riser 52 and production may begin to vessel 42. Alternatively, production may be delayed until one or more additional production wells 54 have been drilled. In FIG. 2, three production wells 54*a*, 54*b*, and 54*c* have been drilled, and are connected to each other by flowlines 51*a* and 51*b*, and are being produced to vessel 42 through production riser 52. One additional well 54d is being drilled by drilling riser 56. Production riser 52 is connected to turret 44, which transmits the produced liquids to topsides facilities 46. Subsequently, when production well 54d has been drilled to its intended depth, production well 54 will be completed and connected to flowline 51, or alternatively to a separate production riser (not depicted), and produced to turret 44. In this manner, the drilling of additional wells from which production is intended to occur may continue at the same time that production is occurring from previously drilled wells. These simultaneous activities are facilitated by the separation on vessel 42 of workstation 48 from the location of turret system 44.

will be understood that production wells 54*a*, 54*b*, 54*c*, and 54*d* in the embodiment of FIG. 1 are located in a generally confined area on the seafloor. That generally confined area, frequently referred to as a drill center, is usually centered approximately below workstation 48. It will be understood that the size of the area within a drill center, and therefore the distances separating the individual wells within a drill center, is limited by a number of technical factors, including drilling riser system characteristics, water depth, the depths of and directions to which the wells are to be drilled, and the like. The wells within a drill center will be drilled without adjustments to mooring lines 50 and without substantial changes in the weather-vaning heading of the vessel. The wells within a drill center may all extend from a well template, or may be a cluster of individual wellheads connected by a single manifold. Note also that the drill center below workstation 48 is separated from the central mooring location of vessel 42, which is located below turret 44. This advantage of the present method results from the separation on vessel 42 of workstation 48 from turret 44, and facilitates simultaneous drilling and production activities within the method of the present invention.

In the method of the present invention, vessel 42 will typically be held in position over the drill center by a temporary auxiliary mooring system which restrains the weathervaning of the vessel. This auxiliary system, not depicted in FIG. 2, may be optional drilling mooring lines located at the workstation end of the RDFPSO. A thruster system may also, or in the alternative, be used in the RDFPSO to maintain vessel 42 at the desired drilling locations.

In the method of the present invention, once all wells which are intended to be drilled from a specific drill center have been drilled, the auxiliary mooring system restraint may be removed, the vessel weather-vaned to a second heading at which the workstation is approximately located over a second drill center, and wells drilled to the second drill center. This process can be repeated any number of times, depending on the number of drill centers that are desired for the field of interest. Once wells have been drilled, production risers and flowlines can be connected and production commenced through turret 44 to topsides facilities 46, either before or after other wells are drilled from the same or subsequent drill centers from which wells are to be drilled, or once all drilling has been completed. Note also that once production has commenced, whenever wells require workover activities, those activities can be commenced from the appropriate drill center using workstation 48 without halting production from other drill centers, and depending on the template and/or manifold system that is used, possibly without halting production from the remaining wells in the drill center corresponding to the well that must be worked-over. This is an economic advantage of the RDFPSO, because the maximum amount of production may be allowed to continue while workover and similar activities are taking place in shut-in wells.

Figure 3:
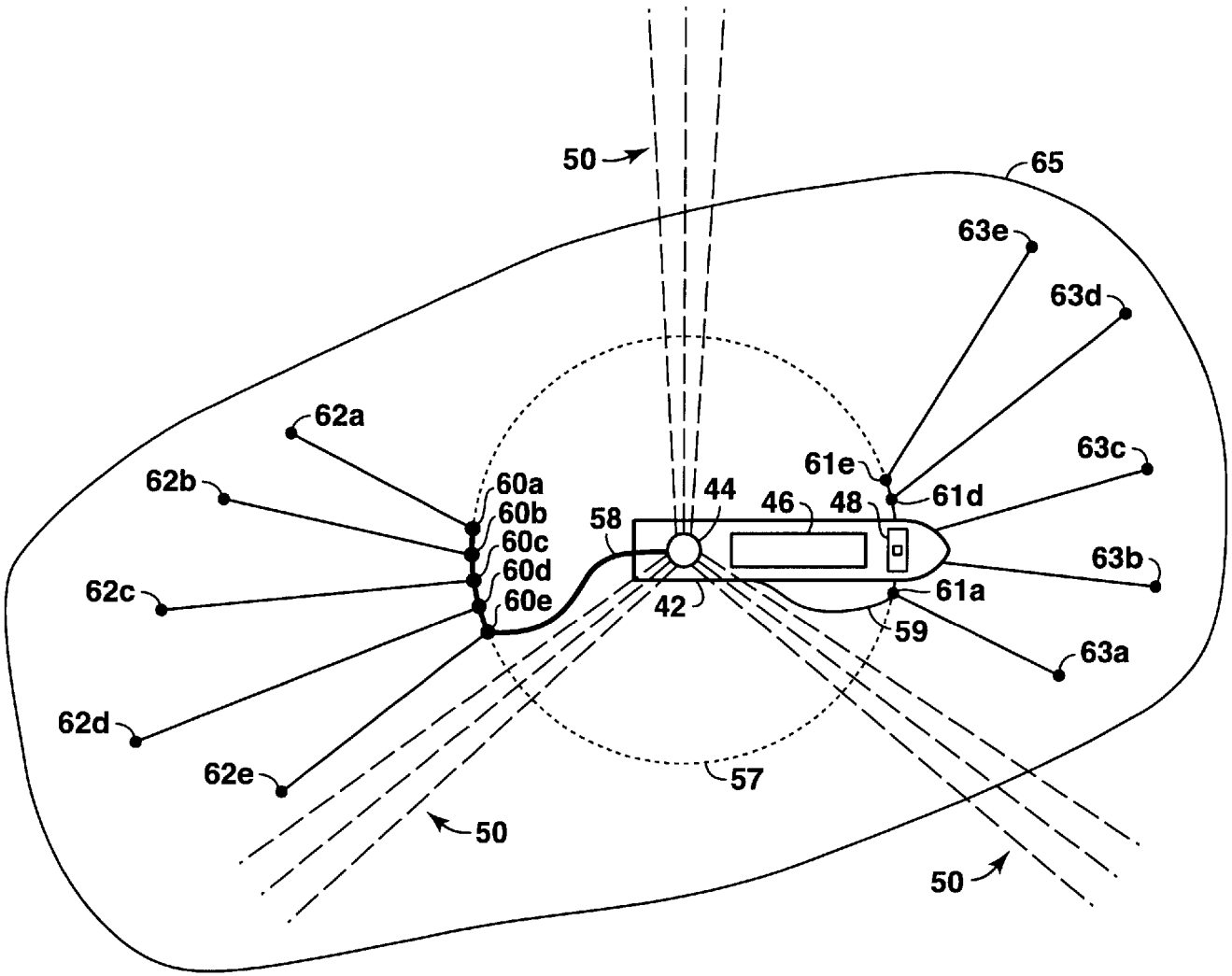
FIG. 3 depicts an aerial view of the first embodiment of the RDFPSO of the present method involving two drill centers.

A further advantage of the RDFPSO is exemplified in FIG. 3, which depicts an aerial perspective of the embodiment of FIG. 2 but depicting two drill centers. Vessel 42 again comprises turret system 44, topsides 46, and workstation 48, and is moored by mooring lines 50. In FIG. 3, a first production riser 58 connects five production wells 60*a*–60*e* from a first drill center to turret system 44. A second production riser 59 connects a second set of five production wells 61*a*–61*e* from a second drill center to turret system 44. In this example the wells in both the first drill center and the second drill center are depicted as laying on a circle 57 whose center is directly below the location of turret system 44. This circular layout is for demonstrative purposes only; the present method is not limited to wells in each drill center laying on a circle. FIG. 3 also depicts the horizontal location of the bottom of each well. For example, well 61*a* has a bottom location 63*a*, and well 60*d* has a bottom location 62*d*. It will be understood that the vertical distance from the top to the bottom of each well is not depicted in this aerial perspective, but only the lateral distance that is traversed as the well extends from the seafloor to its bottom location is depicted. Note that the term "well bottom location" is used generically only; it will be understood to those skilled in the art that the term refers to the portion of the well for which completion activities have or will be carried out and through which hydrocarbons will subsequently flow.

Because the central mooring location of vessel 42 is generally below turret 44, which in this embodiment is near the bow of vessel 42, and because the general location of the drill centers, when wells are being drilled, is below workstation 48, which in this embodiment is near the stern of vessel 42, the radius of circle 57 is slightly less than the length of vessel 42. Note that this geometry is not a limitation of the present method; the workstation could be located at the bow, and the turret at the stem for example. Since vessel 42 rotates around bow-mounted turret 44, the total distance between drill centers on opposite sides of circle 57 will be the diameter of circle 57. For a typical vessel 42, which has a length of 250 meters or more, the result is that the seafloor drill center spacing in the RDFPSO may be as large as 500 meters, or more. As a result, the RDFPSO has the capability of substantially expanding the reach of the wells into more remote portions of the field to be produced, as compared to the wells in a system for which a well template is located directly below turret system 44. The greater reach of the RDFPSO system provides additional flexibility in the production of hydrocarbons due to the increased ability to tailor the well locations and depths to the specific characteristics of the reservoir to be produced, thereby increasing the ability of the RDFPSO to optimize production from the reservoir.

The expanded reach advantage of the RDFPSO is further exemplified by considering the depiction in FIG. 3 of boundary 65 of the field which is to produced from vessel 42. The bottom of each production well will be at a specified location within boundary 65, based on reservoir analyses and production performance predictions, as will be understood to those skilled in the art. These specified well bottom locations will be sectors from which, for example, reservoir analyses suggest that the field can most efficiently be produced. For example, well bottoms 62 may be intended to drain from one or more sectors in a first region of the field. In FIG. 3, the first region is generally on the left side of the drawing. Similarly, well bottoms 63 may be intended to drain from one or more sectors in a second region of the field, which in FIG. 3 is generally on the right side of the drawing. As is apparent in FIG. 3, the location of the drill center associated with wells 60 on the opposite side of circle 57 from the drill center associated with wells 61 enables the bottoms 62 and 63, respectively, to extend to substantially separated sectors of the field, and substantially closer to boundary 65 of the field than would otherwise be possible if a single drill center were used, or if all wells were limited to a location directly below the central mooring location as is the case with through-turret drilling system FPV's. As will be understood to those skilled in the art, the ability of the RDFPSO to extract hydrocarbons from separated sectors in remote corners of a field allows more efficient production of recoverable reserves from the field, and allows production to be optimized in the RDFPSO method as compared to previously proposed systems. In addition, as will also be understood, the ability of the RDFPSO to communicate with wells in the remote corners also facilitates efficient use of injection wells, which also optimizes production.

Note that the geometry of boundary 57 in FIG. 3 is for demonstrative purposes only. Hydrocarbon fields will have various geometries, and the RDFPSO can adapt to those various geometries through the use of additional drill centers. The RDFPSO is not limited to the two drill center examples depicted in the embodiment of FIG. 3, nor to drill centers which are directly opposite each other from the central mooring location.

The production optimization advantage of the RDFPSO directly results from several of the RDFPSO's specific design characteristics. First, the RDFPSO turret and workstation are substantially separated in distance, which directly expands the maximum reach of the system's wells. Previously proposed FPV's have maintained either a workstation operated through the turret or a close spacing between the turret and the workstation. Applicant recognized that use of a turret mounted at one end of the FPV, and a workstation mounted at the other end provided a system in which well reach is substantially lengthened as compared to previously proposed systems, and which at the same time relies on the weather-vaning characteristics of the system to reduce undesirable motion responses of the FPV.

Second, applicant recognized that using such a system facilitates more effective tailoring of the RDFPSO system to the wind, wave, and current design environment for the location of interest. Specifically, certain offshore areas are characterized by seasonal predominant environmental directions. Systems in which weather-vaning is not possible are generally designed to face into the direction which is either most predominant during a year, or is the direction which receives the strongest environmental forces. These systems are constrained to well locations in a relatively small sector down-environment from the direction the vessel faces. The RDFPSO is able to weathervane into each season's predominant direction, thus allowing wells to be placed on a 360° circle around the location of the center of the mooring system. In addition to the extended well reach benefit noted above, the RDFPSO allows wells to be drilled and/or worked-over on a year-around basis, by designing drilling and maintenance programs correlated to the anticipated environmental conditions, and while production from other wells is ongoing. Previous systems do not have this capability, either because of the lack of the ability to weathervane, or the lack of the RDFPSO's improved environmental response characteristics.

Third, prior systems are only able to expand the locations to which they can access wells by active changes to the mooring system, which generally requires complex equipment or support vessels. The RDFPSO's features allowed an expanded reach without these limitations.

Note that although the RDFPSO does not require active changes to the mooring system for drilling and production from multiple drill centers to occur, such changes could be used whenever the characteristics of the field warrant. Specifically, when operations at one or more drill centers for a first central mooring location have been completed, the mooring system, including mooring lines 50 in FIG. 3, could be adjusted such that the vessel was located approximately above a second central mooring location horizontally separated from the first central mooring location. As will be understood, the drill centers for this second central mooring location will be separate and distinct from the drill centers for the first central mooring location. Use of multiple central mooring locations in the RDFPSO thereby allows further flexibility in developing offshore fields. For example, production lines could be connected from the drill centers for the first central mooring location using flexible lines and a subsea catenary riser system that could remain connected while the vessel was moved to the second central mooring location. Once located at the second central mooring location, production could occur from the drill centers of the first central mooring location while operations, such as drilling, occurred at drill centers for the second central mooring location. This option is a further example of how the reach of the wells used in the RDFPSO system can be maximized, thereby maximizing the ability of the RDFPSO to effectively produce from the subject field.

Figure 4:
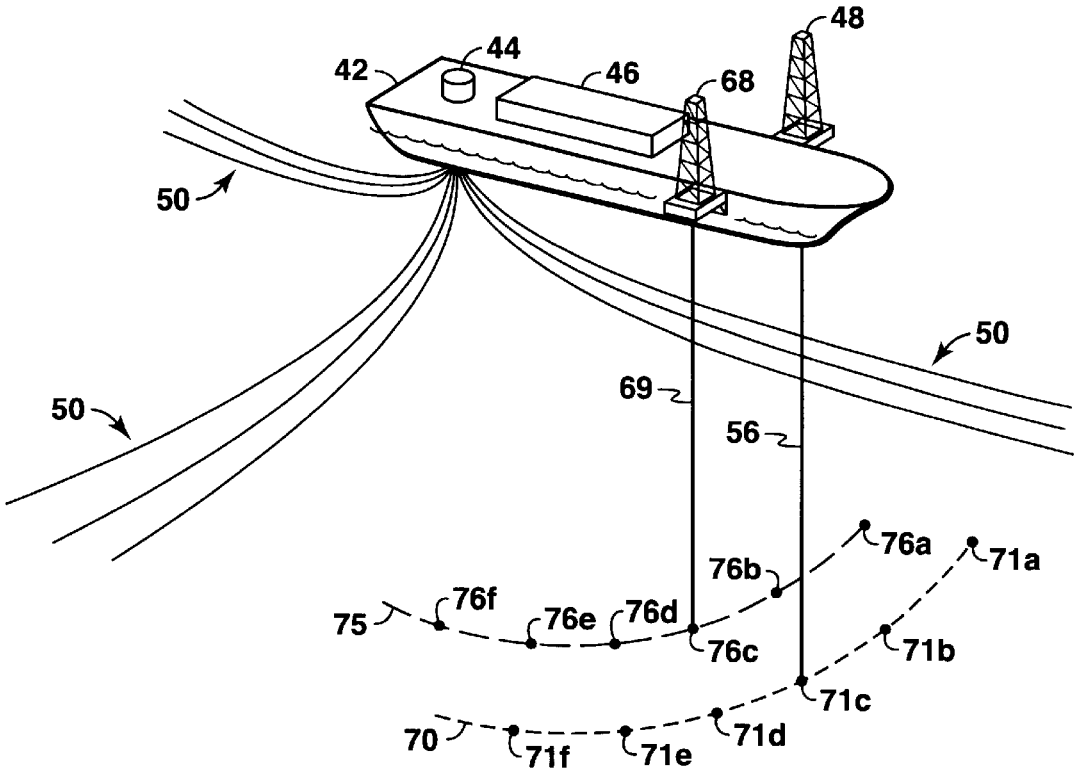
FIG. 4 depicts a two workstation embodiment of the RDFPSO of the present method.

Another embodiment of the RDFPSO system is depicted in FIG. 4. In this embodiment vessel 42 comprises two workstations, 48 and 68, two risers 56 and 69, and a drill center having wells located for convenience but not for limitation along the circumferences of two concentric circles 70 and 75. Circle 75 may have, for example, wells 76 used for production, while circle 70 may have wells 71 used for water injection. Alternately, wells along both circle 70 and circle 75 may involve production. Similarly, workstations 48 and 68 may both be used for drilling, or may both be used for workover of production wells, or may alternate roles depending on the needs of the production system. In this embodiment, the wells along circle 70 and circle 75 are both considered to be in one drill center associated with this weather-vaning heading of vessel 42. For convenience the wells along circle 70 will be referred to as located in an outer segment of the drill center, and the wells along circle 75 will be referred to as located in an inner segment of the drill center. The areal constraints of the wells located in a drill center, as noted above, apply in this embodiment to the wells in each segment. For convenience, production risers and flowlines from wells 71 and 76 are not depicted in FIG. 4.

This embodiment demonstrates the substantial added flexibility to the RDFPSO as compared to previously proposed systems. For example, as production continues from wells 76, reservoir analyses may show that injection wells are required at certain specific locations in the outer segment of the drill center along circle 70. This embodiment allows production to continue, while drilling is ongoing for any such injection well. In addition, the drilling and/or workover of production wells 76 may also occur. The distance between the outer and inner segments of a drill center will depend on the water depth, and the level of compliance and allowable stresses in risers 69 and 56. Note also that use of an auxiliary mooring system from the stem 43 of vessel 42, with or without adjustments to mooring lines 50, would if necessary or desirable allow lateral offset of the RDFPSO, such that workstation 48 or 68 could be positioned over either arc of subsea wells. Note that although only one drill center, having two segments, is depicted in FIG. 4 additional drill centers may be employed for this central mooring location.

As will be understood to those skilled in the art, the placement of wells on the seafloor will not be limited to circular geometries centered on the central location of the RDFPSO's turret. Rather, any geometry may be used which effectively produces hydrocarbons from the hydrocarbon reservoir of interest. That geometry can also be tailored to the local environmental conditions, such that at least one or more well locations are accessible for drilling or work-over for each principle direction that the RDFPSO may weathervane in response to those conditions.

In each of the above-described embodiments, offloading hawsers may be installed to enable connection at bow or stern of the RDFPSO vessel 42 for offloading to tankers.

It should be understood that the preceding is merely a detailed description of specific embodiments of this invention. Other embodiments may be employed and numerous changes to the disclosed embodiments may be made in accordance with the disclosure herein without departing from the spirit or scope of the present invention. The preceding description, therefore, is not meant to limit the scope of the invention. Rather, the scope of the invention is to be determined only by the appended claims and their equivalents.

What is claimed is:

1. A method of conducting operations to an offshore field from multiple separated drill centers, the method using a floating vessel having a turret-mounted mooring element and further having a workstation horizontally spaced apart from the mooring element, comprising the steps of:

a) locating the mooring element approximately over a first mooring element location;

(b) limiting the horizontal movement of the mooring element using a plurality of mooring lines extending from the mooring element;

(c) allowing the vessel to weathervane such that the workstation is substantially vertically aligned over a first drill center associated with the first mooring element location;

(d) temporarily restraining the weathervaning of the vessel;

(e) using the workstation to conduct operations in at least one well from the first drill center to the field;

(f) removing the weathervaning restraint while continuing to limit horizontal movement of the mooring element and repeating steps (c), (d) and (e) for one or more additional drill centers associated with the first mooring element location.

2. The method of claim 1 wherein the drill centers are located on an arc with the center of the arc falling on a vertical axis passing approximately through the first mooring element location.

3. The method of claim 1 where the wells in each of the drill centers are associated with a sector of the field, the bottom location of each such well located within such sector.

4. The method of claim 1 comprising the additional steps of:

(g) providing product receiving means in the mooring element for receiving hydrocarbon product lines from one or more of the drill centers;

(h) providing means for passing hydrocarbon product from the product receiving means to topside facilities onboard the vessel; and (i) simultaneously with conducting the operations of step (e), passing hydrocarbon product from one or more of the drill centers to the topside facilities.

5. The method of claim 1 comprising the additional steps of:

(g) re-positioning the mooring element approximately over a second mooring element location;

(h) limiting the horizontal movement of the mooring element using a plurality of mooring lines extending from the mooring element;

(i) allowing the vessel to weathervane such that the workstation is substantially vertically aligned over a first drill center associated with the second mooring element location;

(j) temporarily restraining the weathervaning of the vessel;

(k) using the workstation to conduct operations in at least one well from the first drill center associated with the second mooring element location.

6. The method of claim 5, comprising the additional step of (l) removing the weathervaning restraint of step (j) while continuing to limit horizontal movement of the mooring element and repeating steps (g), (h) and (i) for one or more additional drill centers associated with the second mooring element location.

7. The method of claim 5 comprising the additional steps of:

(l) providing product receiving means in the mooring element for receiving hydrocarbon product lines from the drill centers associated with at least one of the mooring element locations;

(m) providing means for passing hydrocarbon product from the product receiving means to topside facilities onboard the vessel; and (n) simultaneously with conducting the operations with the workstation, passing hydrocarbon product to the topside facilities.

8. The method of claim 5 wherein the drill centers for the first mooring element location form an arc with the center of the arc falling on a vertical axis centered approximately on the first mooring element location and the drill centers for the second mooring element location form a second arc with the center of the second arc falling on a vertical axis centered approximately on the second mooring element location.

9. A method of conducting operations to an offshore field from multiple separated drill centers, the method using a floating vessel having a turret-mounted mooring element and further having a first workstation horizontally spaced apart from the mooring element and further having a second workstation, comprising the steps of:

(a) locating the mooring element approximately over a first mooring element location;

(b) limiting the horizontal movement of the mooring element using a plurality of mooring lines extending from the mooring element;

(c) allowing the vessel to weathervane such that the first workstation is substantially vertically aligned over a first drill center associated with the first mooring element location;

(d) temporarily restraining the weathervaning of the vessel;

(e) using the first workstation to conduct operations in at least one well from a first segment of the first drill center while simultaneously using the second workstation to conduct operations in a well from a second segment of the first drill center;

(f removing the weathervaning restraint while continuing to limit horizontal movement of the mooring element and repeating steps (c), (d) and (e) for one or more additional drill centers associated with the first mooring element location.

10. The method of claim 9 wherein the first segments of each of the drill centers are located on an arc with the center of the arc falling on a vertical axis passing approximately through the first mooring element location, and the second segments of each of the drill centers are located on a second arc with the center of the second arc falling on a vertical axis passing approximately through the first mooring element location.

11. The method of claim 9 where the wells in each of the segments are associated with a sector of the field, the bottom location of each such well located within such sector.

12. The method of claim 9 comprising the additional steps of:

(g) providing product receiving means in the mooring element for receiving hydrocarbon product lines from one or more of the segments;

(h) providing means for passing hydrocarbon product from the product receiving means to topside facilities onboard the vessel; and (i) simultaneously with conducting the operations of step (e), passing hydrocarbon product from one or more of the segments to the topside facilities.

* * * * *